US006470725B1

(12) United States Patent
Boschiero

(10) Patent No.: US 6,470,725 B1
(45) Date of Patent: Oct. 29, 2002

(54) METHOD OF CONTINUOUSLY AND CONTROLLEDLY VARYING THE INITIAL STRESS OF SPRINGS DURING THEIR PRODUCTION AND A MACHINE FOR CARRYING OUT SUCH A METHOD

(75) Inventor: Giuseppe Boschiero, S. Giuliano Milanese (IT)

(73) Assignee: Simplex Rapid di Boschiero Corrado e Giancarlo S.r.l. (IT)

( * ) Notice: Subject to any disclaimer, the term of this patent is extended or adjusted under 35 U.S.C. 154(b) by 0 days.

(21) Appl. No.: 09/688,320

(22) Filed: Oct. 13, 2000

(30) Foreign Application Priority Data

Oct. 19, 1999 (IT) ..... MI99A2187

(51) Int. Cl.[7] ..... B21F 3/02
(52) U.S. Cl. ..... 72/138
(58) Field of Search ..... 72/138, 145, 140

(56) References Cited

U.S. PATENT DOCUMENTS 3,342,052 A * 9/1967 Boy ..... 72/138
5,127,247 A * 7/1992 Baisch ..... 72/138
5,442,944 A * 8/1995 Lu ..... 72/138

* cited by examiner

*Primary Examiner*—Lowell A. Larson
(74) *Attorney, Agent, or Firm*—Ostrolenk, Faber, Gerb & Soffen, LLP

(57) ABSTRACT

A method for the production of springs in winding machines provided with one or two winding noses at the winding mandrel of the spring, wherein the or at least one of the winding noses is initially rotated through a given angle such as to create the appropriate stress in the end turn of the spring and subsequently the nose is rotated into one or more angular positions to provide the stress required for the subsequent turns. The spring production machine for carrying out such a method provides angular rotation of the winding nose or noses for winding the wire of the spring, for example levers controlled by a pneumatic or oleodynamic control or an electric motor.

9 Claims, 5 Drawing Sheets

METHOD OF CONTINUOUSLY AND CONTROLLEDLY VARYING THE INITIAL STRESS OF SPRINGS DURING THEIR PRODUCTION AND A MACHINE FOR CARRYING OUT SUCH A METHOD

BACKGROUND OF THE INVENTION

Machines for the production of compression and/or tension springs may be either of a purely mechanical type or a type involving numerical control, and be provided with one or two noses for winding or forming the turns of the spring, so as to impart to the spring precise dimensions and the required initial stress. The procedure sometimes involves, in terms of the equipment of the machine, a suitable initial fixed rotary movement of one or both of said winding noses, for the purposes of achieving for example the desired characteristics in regard to planarity of the end turns and of closing them up. In particular, in machines provided with two winding noses, the upper winding nose is mostly rotated in the case of right-hand coil springs while the lower nose is mostly rotated for left-hand coil springs.

Since normally the wire slides in the longitudinal direction within a short groove or channel portion provided on the end of each winding nose, the rotary movement of the winding nose about its own axis requires the wire to slide against two opposite edges of the sides of the groove, causing the wire to experience an orientation effect such as to permit it to achieve the desired preload value in the finished product.

The preload value or initial tension can vary greatly for compression springs or tension springs, where the term 'initial tension' used in this art generally denotes the fact of imparting to the wire a tendency to hold the turns of the spring in a condition in which they are closed up together.

For normal compression springs which do not require grinding operations it is sufficient to impart only a modest initial stress in order to achieve an acceptable arrangement of the end or terminal turns. In the case of springs which require a grinding operation to give flat ends, the initial tension has to be higher insofar as the grinding operation causes a rise in temperature of the wire with relaxation of the stresses internal to the material and thus possibly causing undesired opening of the ends. Finally for tension springs which are already characterised by a constant preload along the entire extent of their body, a high or very high initial tension is generally required.

In any case, in terms of the equipment of the machine, the rotary movement of at least one of the winding noses for achieving a correct value in respect of the initial stress, if the at least one winding nose has remained fixed for the entire production cycle, involves various disadvantages such as for example:

a) in cylindrical compression and tension springs, the first turn has a shape which is curved in the axial direction, at a position corresponding to the initial end of the spring, and b) in the case of tapered springs with a spring body which is either straight or concave or convex, which, besides fault a), always involve a gradual decrease in the initial stress as the diameter of the spring increases, the fixed correction which applies in respect of the first turns of the spring is no longer sufficient for the last turns of larger diameter, giving rise to possible opening effects at the final end of the spring. Obviously the more the initial stress imparted to the turns of the spring is accentuated, the greater will be the amount of undesirable deformation phenomena at the initial end of the spring; vice-versa, an excessive reduction in the initial stress for nullifying such deformation at the initial turn involves the certainty of the final end of the spring opening.

c) In general, all compression springs with medium or high pitch values bear scrape marks on the wire which are due to the high contact pressure which is generated at the edges of the passage of the winding nose, as a result of the high variation in the helical angle as between the end turns and the spring body. Both (i) those scrape marks on the wire and (ii) the consequential wear of the edges of the passage of the winding noses can be avoided only by virtue of variable orientation of the winding nose in dependence also on the pitch, something which is impossible at the present time with just the stratagem of providing a fixed initial orientation for the winding nose.

SUMMARY OF THE INVENTION

The aim of the invention is that of controlling the stress of the wire throughout the entire process of forming the spring by continuously varying it in such a way as to obviate the above-mentioned faults.

In accordance with the invention the method provides for continuous angular correction of the winding nose in machines which are provided with a single nose or of at least one of the winding noses in machines which are provided with several winding noses, in the course of the production cycle of each individual spring, such correction being effected in accordance with laws dictated by calculation and/or practical tests and being repetitive with a cyclic return to an initial position. Repetition of the cycle can be easily linked for example in accordance with the length of the wire which is supplied for producing an element or by the position of the cutting blade which shears the wire at the end of the spring cycle.

A further advantage which derives from the fact of controlling the rotary movement of the winding nose is that of also making it possible to implement compression springs with modest pitch values without the use of the tool (divider) for achieving the desired pitch; it is in fact possible in those cases to give the pitch to the spring by the simple rotary movement of the winding nose, avoiding equipping the machine with the divider tools.

The mechanism for controlling the rotary movement of the winding nose in accordance with the method of the invention can for example be one of three types:

1) the shaft bearing the winding nose for the turns of the spring may be coupled to a suitable mechanical system involving a cam and a lever;

2) the shaft bearing the nose may be rotated by means of a lever moved by a piston which is pneumatic or oleodynamic, under the control of actuators; and 3) the shaft of the nose can be moved directly by an electric motor which is possibly provided with a reduction unit and controlled electronically in accordance with a preset program.

BRIEF DESCRIPTION OF THE DRAWING

The present invention will be better appreciated from the following description given by way of example with reference to the accompanying drawings, in which.

DETAILED DESCRIPTION OF THE DRAWINGS

The method in accordance with the invention for actuating the controlled variation in stress will now be described by way of example in relation to some embodiments of a machine for the production of springs.

Figure 1:
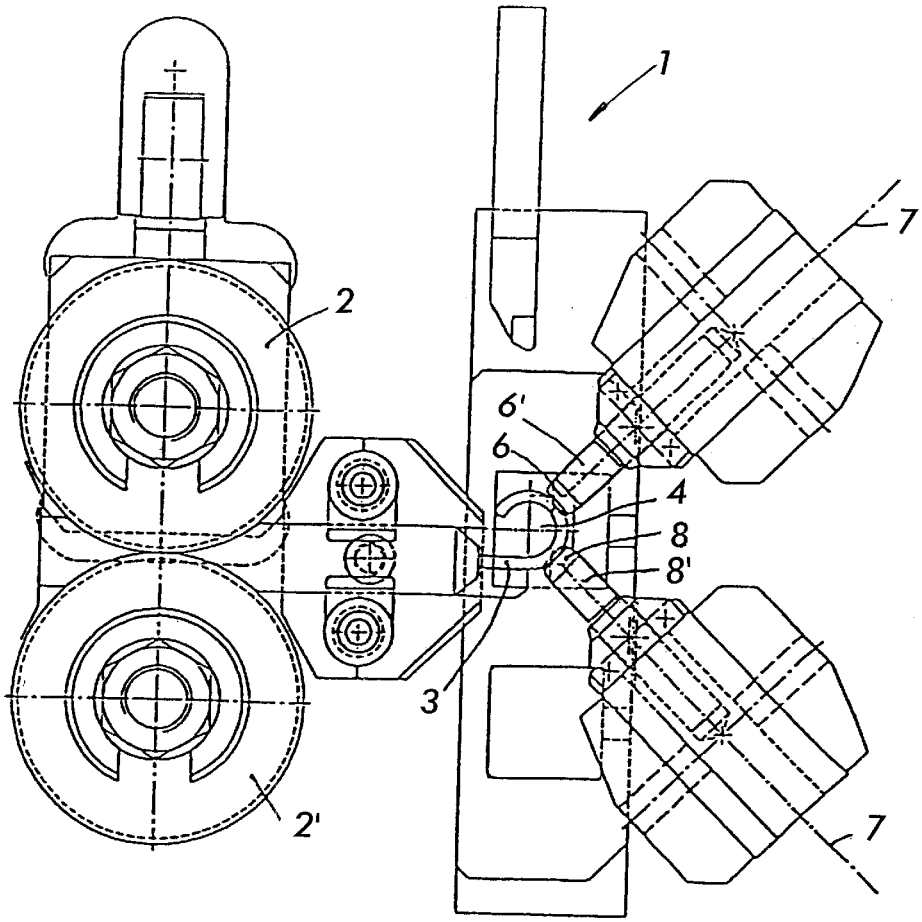
FIG. 1 is a diagrammatic front elevation showing the operative zone of a machine for producing springs which is provided with two winding nose for turns.

Referring to FIG. 1, the machine 1 for the production of springs, of which only part is diagrammatically illustrated, comprises one or more pairs of rolls 2, 2' for the forced feed of the wire 3 which is caused to wind around a mandrel 4.

In the machine for producing springs which is being considered here, in order that it will assume the appropriate curvature the wire is guided by two winding noses 6 and 8 which are each provided with a U-shaped recess, in the bottom of which the wire slides to receive the thrust force to divert it around the mandrel 4. The heads 6, 8 are mounted on a respective shaft 6', 8', each of which can rotate about its own axis 7 through a given angle in such a way as to align the U-shaped recess in a direction which will impart to the wire the tendency to be disposed in more or less tight turns, with a given initial stress.

Figure 3:
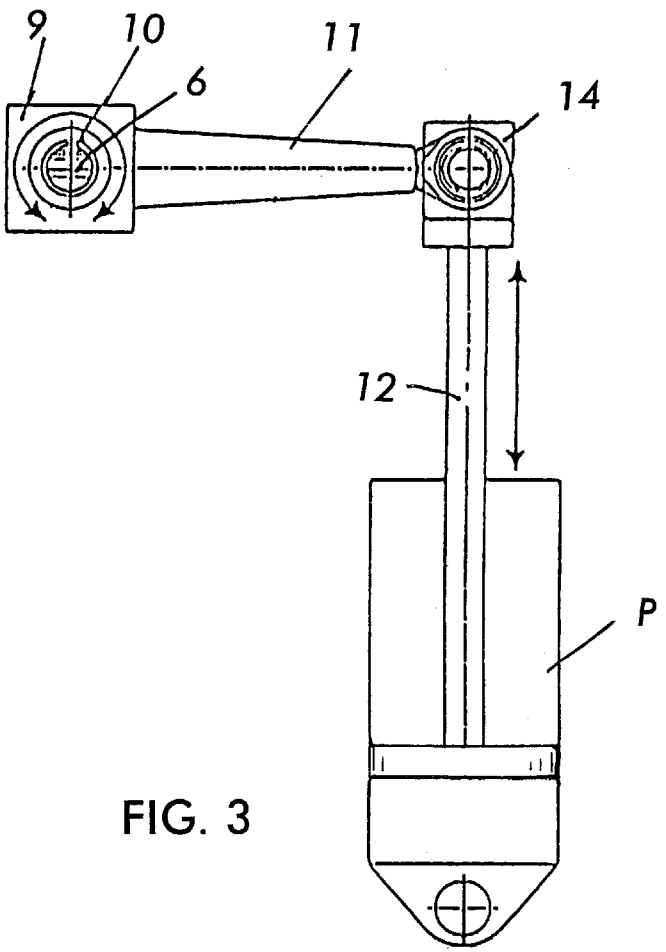
FIG. 3 is an elevational side view showing the lever control for the winding nose which is diagrammatically illustrated in FIG. 2.
Figure 2:
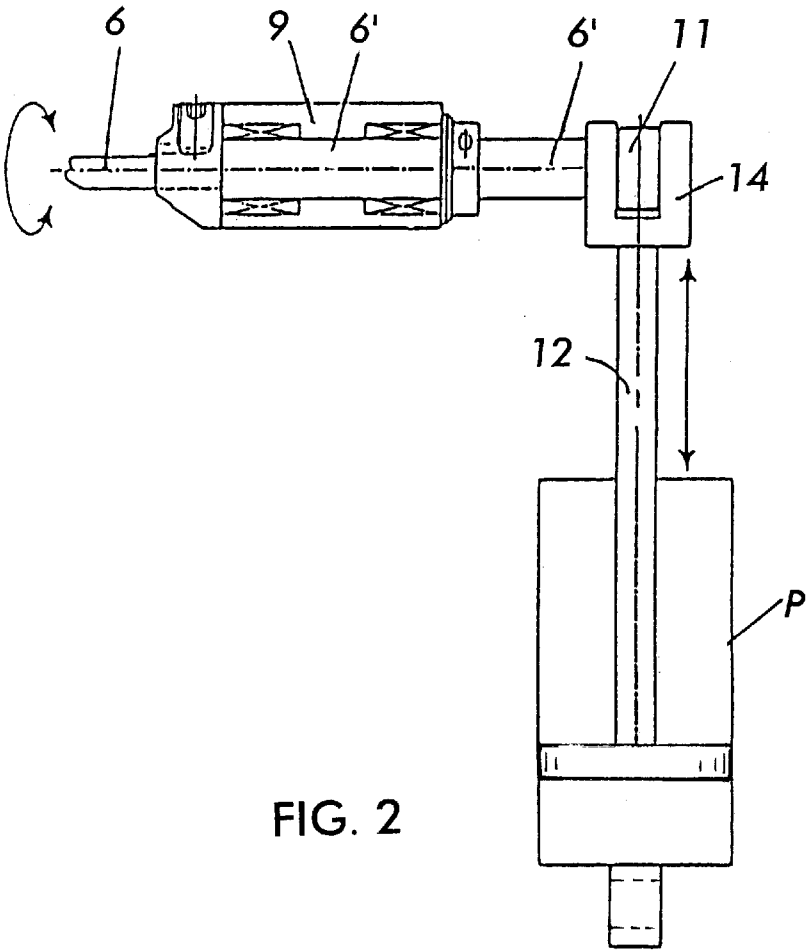
FIG. 2 is a diagrammatic front elevation, on an enlarged scale, of one of the winding noses shown in FIG. 1 carried on a shaft, whose rotation is effected by a lever-type control, the arm of which is connected for example to an oleodynamic or pneumatic cylinder.

FIGS. 2 and 3 respectively show diagrammatically, as a front elevation and a side elevation, a mechanical configuration in which for example the winding nose 6 is linked to a shaft 6' which rotates on bearings within a casing 9, the shaft comprising a lever arm 11 which can be engaged by the rod 12 of a pneumatic or oleodynamic piston P by way of a forked joint 14.

Figure 4:
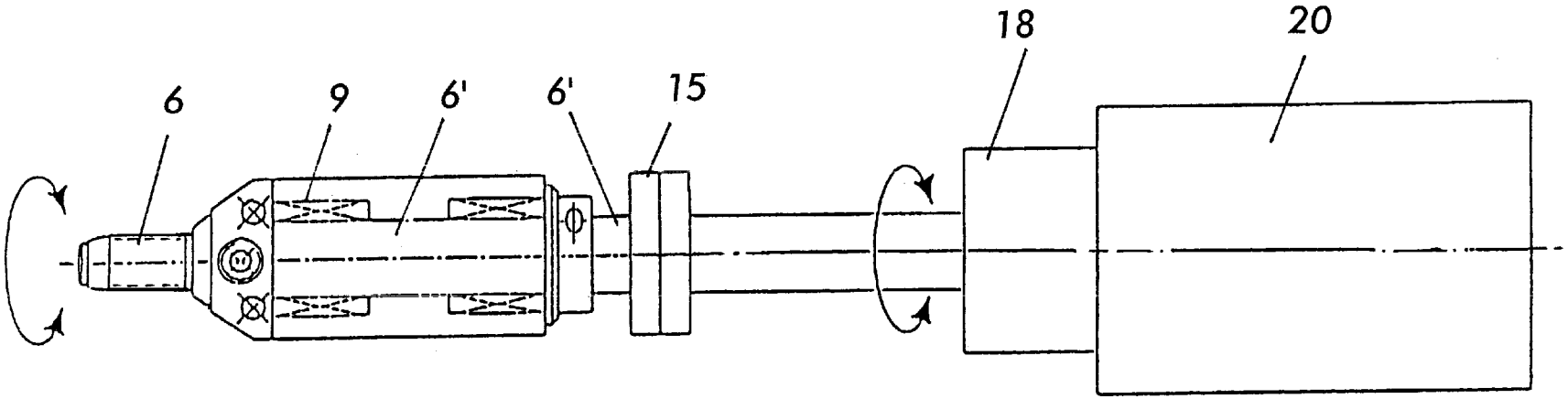
FIG. 4 is a diagrammatic front elevation showing the shaft which carries the winding nose and which is directly connected to an electric motor by way of an associated reduction unit.

FIG. 4 shows again diagrammatically an alternative structure involving direct rotation of the shaft 6' carrying the nose 6 and connected by a joint 15 to the output of a reduction unit 18 which is driven by an electric motor 20. The motor 20 can be driven under electronic control by means of a processor which is programmable in accordance with the type of spring and in dependence on the length of wire supplied.

The suitability of providing for control of the rotary movement of the winding nose or noses is clearly apparent from the illustration of the defects which can be found on finished springs produced with a fixed orientation of the winding nose or noses in regard to the equipment of the machine.

Figure 5A:
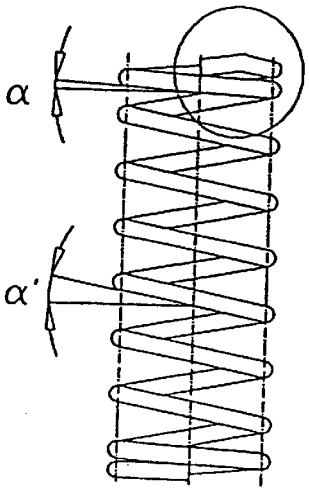
FIGS. 5A, 5B and 5C respectively show by way of example the different spring types, namely a cylindrical compression spring, a cylindrical tension spring and a tapered spring, which are produced by a fixed rotary movement of the winding noses forming part of the equipment of the machine.
Figure 5D:
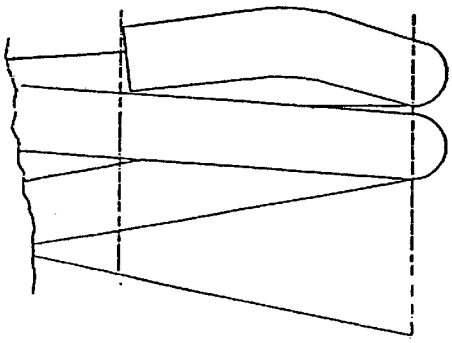
FIG. 5D is a view on an enlarged scale showing the defect in the initial turn of the springs shown in FIGS. 5A, 5B and 5C.

As can be seen from FIG. 5A, in compression springs in which there is a medium or substantial variation in the helical angle between the end turns and the spring body (which for example in the drawing goes from $\alpha$ to $\alpha'$), it is very important to afford the possibility of being able to support that variation by rotating the winding nose within the spring winding cycle.

Figure 5B:
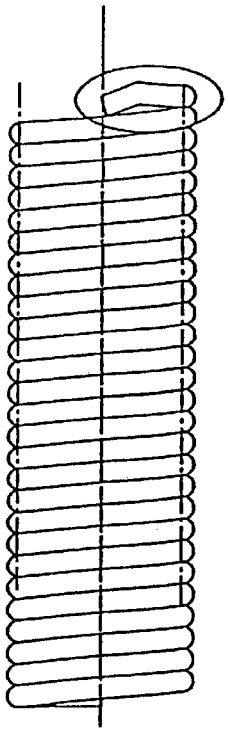
Figure 5C:
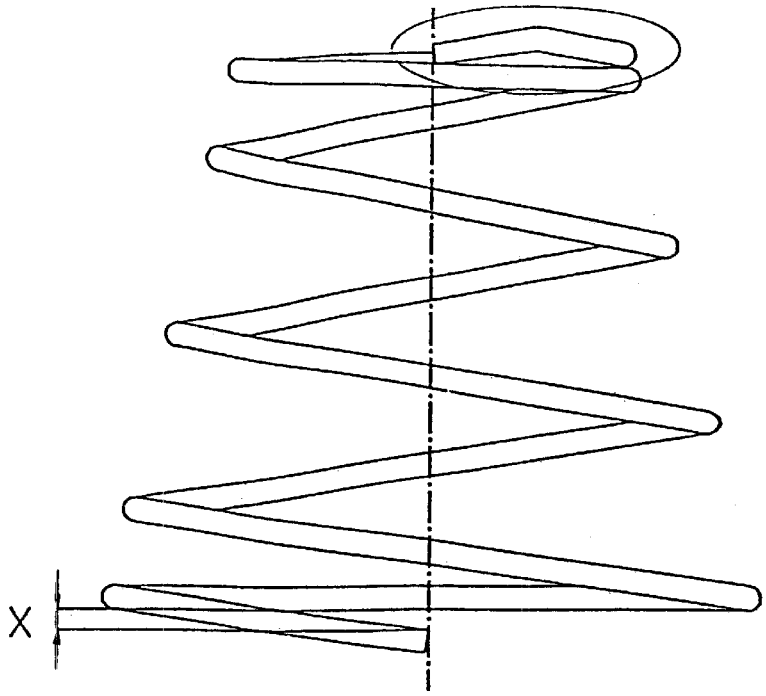

In addition FIG. 5 shows the typical curvature of the initial portion of the first turn of the spring, repeated in the tension spring shown in FIG. 5B and the tapered spring shown in FIG. 5C. That defect which is shown on an enlarged scale in FIG. 5D can be accepted for springs of the current type but it involves a greater problem when a planar condition is required for the opposite ends of the springs to be implemented by means of grinding.

Figure 6A:
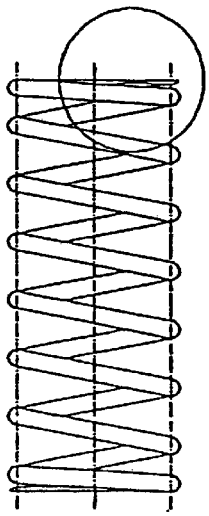
FIG. 6A shows a further adverse consequence of the defect in the initial turn shown in FIG. 5D, after the phase of grinding the end which is implemented for example on a compression spring produced by fixed rotary movement of the winding nose.
Figure 6B:
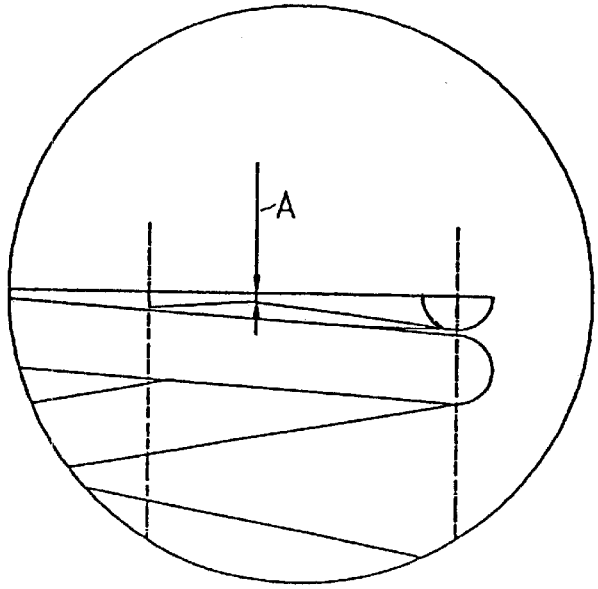
FIG. 6B is a view on an enlarged scale showing the defect illustrated in FIG. 6A.
Figure 7A:
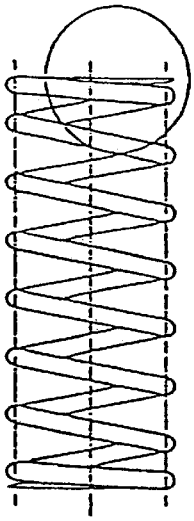
FIGS. 7A and 7B respectively show on a normal scale and on an enlarged scale the result obtained on a compression spring produced with variable rotary movement, in accordance with this invention, of the nose or noses for winding the wire, after the phase of grinding the ends.
Figure 7B:
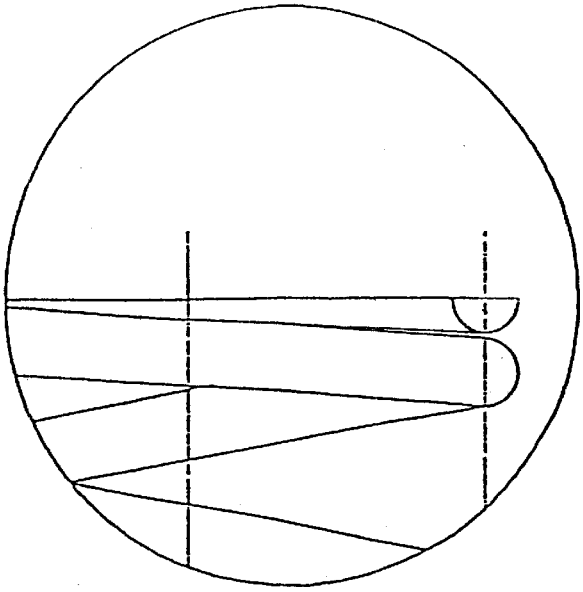

As can be seen from FIG. 6A, and on an enlarged scale from FIG. 6B, the grinding operation results in a reduction in the cross-section A of the turn, with the risk of fracture, while FIGS. 7A and 7B show the advantage achieved with the procedure in accordance with the invention, whereby the defect of curvature of the end turn is eliminated and the end of the spring is no longer subject to fracture.

Finally, control of the correction of forcing of the wire also makes it possible to maintain the planar condition of the last larger-diameter turn of tapered springs by avoiding the undesired opening effect with respect to the lower plane, as is indicated at X in FIG. 5C, due to the decrease in the effect of fixed initial tension with the increase in diameter.

Figure 8:
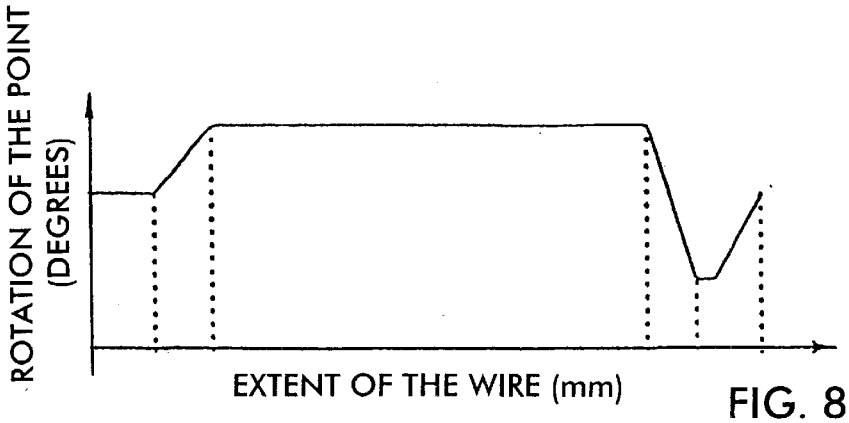
FIG. 8 illustrates a qualitative diagram in respect of the variable configuration of the initial stress expressed in degrees of rotation of the winding nose in dependence on the wire supplied, in the case of a cylindrical spring.
Figure 9:
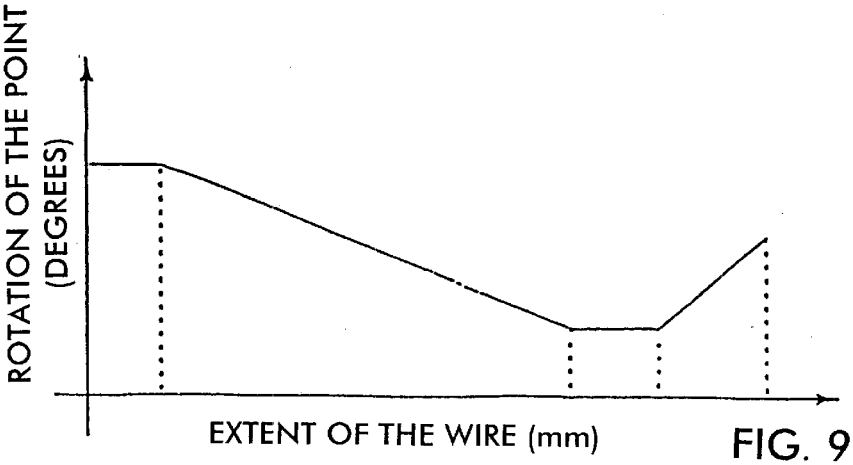
FIG. 9 illustrates a qualitative diagram in respect of the variable configuration of the initial stress expressed in degrees of rotation of the winding nose in dependence on the wire supplied, in the case of a tapered spring.

Qualitative examples in regard to the variation in the rotary movement of any winding nose for the wire within the context of the winding cycle for a spring are shown in FIGS. 8 and 9.

In these Figures the variation in the initial stress is expressed in relation to the ordinate axis, in sexagesimal degrees of rotation of the winding nose, while the abscissa axis shows the extent of the wire necessary for the production of a given spring.

In the specific cases involved FIG. 8 relates to a cylindrical spring while FIG. 9 relates to the production of a tapered spring.

What is claimed is:

1. A method for producing a spring from wire in a winding machine, wherein the machine includes a mandrel extending along a respective mandrel axis around which a wire is wound and at least one winding nose which engages the wire near the mandrel, the nose having a rotation axis;

the method comprising;

advancing a wire toward the at least one nose and engaging the wire on the nose;

rotating the nose around a rotation axis that is across the mandrel axis and with respect to the mandrel to a first rotative angular position of the nose as a leading end of the wire is slid against and then past the nose as the wire is advanced past the nose in the first position to create a first selected stress at the end turn of the wire and for urging the first stressed end turn of the wire to wrap around the mandrel as the wire is advanced past the nose;

then rotating the nose around the rotation axis with respect to the mandrel to a second rotative angular position different from the first position of the nose as the wire is advanced beyond the end turn for creating a second stress in subsequent turns of the wire as the wire is turned by the nose to wind around the mandrel.

2. A spring producing apparatus for producing a spring which has an end turn and subsequent turns following the end turn, the apparatus comprising:

a mandrel on which a spring is to be wound and the mandrel having an axis which defines the axis of the spring being wound;

a wire advancing device for advancing a wire that is to be wound into a spring to the mandrel;

a winding nose for being engaged and slid over by the wire being advanced by the advancing device, the nose being located at the mandrel and being shaped and positioned for redirecting the advancing wire to wrap around the mandrel as the wire slides past the nose to move along the mandrel axis to form a spring;

the nose being rotatable around a rotation axis that is across the mandrel axis to a first rotative angular position as the leading end of the wire is advanced past the nose for creating a first selected stress at the leading end turn of the advancing wire and for urging the first stressed end turn of the wire to wrap around the mandrel as the wire is advanced past the nose; and then the nose being rotatable around the rotation axis with respect to the mandrel to a second rotative angular position different from the first position of the nose as the wire advances beyond the end turn for creating a second stress in subsequent turns of the wire as the wire is turned by the nose around the mandrel.

3. The apparatus of claim 2, further comprising a controller connected to the winding nose for controlling the rotation of the winding nose between the first and the second rotative angular positions.

4. The apparatus of claim 3, wherein the controller comprises a lever connected to the nose to rotate the nose and a device connected with the lever to move the lever to rotate the nose.

5. The apparatus of claim 4, wherein the device connected with the lever comprises a pneumatic or an oleodynamic piston reciprocable across the rotation axis of the nose and connected with the lever to move the lever to rotate the nose.

6. The apparatus of claim 5, wherein the device comprises an actuator for the piston which is electronically controlled by a program dependent upon characteristics of the spring being wound.

7. The apparatus of claim 3, wherein the controller comprises a shaft on which the nose is supported to rotate, a motor connected with the shaft and operable to move the shaft between the angular positions thereof.

8. The apparatus of claim 7, wherein the controller is electronically controlled by a program dependent upon characteristics of the spring being wound.

9. The apparatus of claim 7, further comprising a reduction unit for the motor and fitted to the shaft supporting the nose and for driving the shaft to rotate between the positions thereof.

* * * * *